US005195662A

United States Patent [19]

Neff

[11] Patent Number: 5,195,662

[45] Date of Patent: Mar. 23, 1993

[54] PAINT CAN SPOUT ATTACHMENT

[76] Inventor: Ted Neff, 24701 Raymond Way, #115, Lake Forest, Calif. 92630

[21] Appl. No.: 850,345

[22] Filed: Mar. 11, 1992

Related U.S. Application Data

[63] Continuation-in-part of Ser. No. 687,458, Apr. 17, 1991, abandoned, which is a continuation-in-part of Ser. No. 249,290, Sep. 26, 1988, abandoned, which is a continuation-in-part of Ser. No. 81,018, Aug. 3, 1987, abandoned.

[51] Int. Cl.[5] ..... B67D 5/72

[52] U.S. Cl. ..... 222/108; 222/570; 222/571; 220/85 SP

[58] Field of Search ..... 222/570, 571, 569, 575, 222/567, 108, 109; 220/90, 285 SP

[56] References Cited

U.S. PATENT DOCUMENTS

| | | | |
|---|---|---|---|
| 2,106,381 | 1/1938 | Rough | 221/23 |
| 2,145,748 | 1/1939 | Bailey | 221/23 |
| 2,471,189 | 5/1949 | Bartels | 210/163.5 |
| 2,521,523 | 9/1950 | Kemper | 222/571 |
| 2,627,367 | 2/1953 | Bork | 222/570 |
| 2,646,193 | 7/1953 | Best | 222/570 |
| 2,720,346 | 10/1955 | Compton | 222/570 |
| 2,765,966 | 10/1956 | Davis | 222/570 |
| 2,767,891 | 10/1956 | Beadles | 222/570 |
| 2,817,465 | 12/1957 | Gray | 222/570 |
| 3,074,604 | 1/1963 | Baroud | 222/569 |
| 3,102,667 | 9/1963 | Ullevig | 222/569 |
| 3,221,955 | 12/1965 | Banaszak | 222/570 |
| 3,309,000 | 3/1967 | Haverstick | 222/570 X |
| 3,400,867 | 9/1968 | Giannone | 222/570 |
| 3,695,488 | 10/1972 | Olsson | 222/570 |
| 3,853,249 | 2/1974 | Weir, Jr. et al. | 222/570 |
| 4,009,802 | 3/1977 | Haydechok | 222/108 |
| 4,225,064 | 9/1980 | Westcott | 222/570 X |
| 4,240,568 | 12/1980 | Pool | 222/570 X |
| 4,299,340 | 11/1981 | Hrytzak | 222/570 X |
| 4,893,723 | 1/1990 | Seabolt | 222/570 X |
| 5,012,960 | 5/1991 | Arnold | 222/570 |

FOREIGN PATENT DOCUMENTS

| | | | |
|---|---|---|---|
| 56286 | 6/1939 | Denmark | 222/571 |
| 196400 | 6/1907 | Fed. Rep. of Germany | 222/571 |
| 195828 | 11/1936 | Switzerland | 222/571 |
| 245336 | 7/1947 | Switzerland | 222/571 |
| 7794 | 2/1986 | United Kingdom | 222/571 |

*Primary Examiner*—Andres Kashnikow
*Assistant Examiner*—Kenneth DeRosa

[57] ABSTRACT

A pouring spout attachment for cans of the type generally used for paints, stains, varnishes and the like that prevents paint or other liquids from running down the outside of the spout, into the lid groove, or down the outside of the can. The spout is constructed in such a way that it compensates for variations in can dimensions found in cans having the same capacity but made by different manufacturers, and also has a brush wipe bar having two functional edges; one straight smooth edge for wiping excess paint out of a brush when painting directly from a can, and a second straight serrated edge for stripping most of the paint from a brush preparatory to cleaning it after the painting job has been completed.

6 Claims, 2 Drawing Sheets

PAINT CAN SPOUT ATTACHMENT

CROSS REFERENCE TO RELATED APPLICATIONS

This application is a Continuation-In-Part of my prior application Ser. No. 07/687,458, filed Apr. 17, 1991, now abandoned which is a Continuation-In-Part of my application Ser. No. 07/249,290, filed Sep. 26, 1988, now abandoned, which was a Continuation In Part of my parent application Ser. No. 07/081,018, filed Aug. 3, 1987, also abandoned.

BACKGROUND

This invention relates to an attachment for paint cans and the like, and more particularly to a pouring spout for cans which prevents paint or other liquids being poured from such cans from accumulating in the groove or running down the side of the can, and which has a number of other useful functions.

The invention comprises a combination of several elements to provide a pouring spout with advantageous features not possessed by any other pouring device in the prior art. Anyone who has ever painted has experienced the problem of trying to pour paint or other liquids out of cans of the type referred to in a neat and clean manner, only to find that it is practically impossible to do so. The problem arises in that the metal cans for such materials are lacking in any means to dispense the contents in a satisfactory manner without filling the can lid sealing groove and spilling some of the contents down the outside of the can. This causes waste and a very messy clean-up. In addition, if painting is accomplished by withdrawing paint directly from the can with a brush and the common practice of wiping the brush on the rim of the can to remove excess paint is utilized, the attendant filling of thelid groove is a certainty and if the accumulated paint is not removed, prevents the lid from being resealed properly as well as typically causing paint to be spattered over the surrounding area as the lid is struck a blow to reseal it.

Over the past fifty years or more, many attempts have been made in the prior art to produce an acceptable paint can pouring spout product to meet the need in the art, but they all have one or more of the following problems:

Problem #1: They were made with means to fit a specific dimension on a can and therefore would fit only cans made by one or two manufacturers. Can manufacturers do not make their cans exactly the same, each having their own unique specifications. The result was a large number of cans having different dimensions, even though they have the same capacity, which prevented universal use of the prior art pouring spouts on all paint cans.

Problem #2: They did not have sufficiently effective pouring means to prevent paint from either running down the outside, into the lid groove, or down the outside of the can, or else did not have fully effective means for preventing paint from accumulating in the lid groove from inside the can during a pouring operation because of the differing dimensions.

Problem #3: They did not encircle the top of the can far enough to prevent paint from running over the inner ends or sides of the device when pouring from a full can.

Problem #4: They did not have a separate and adequate means for wiping excess paint out of a brush when painting directly from a can, and in such a manner that all of the paint would run back into the can, nor did they have means for stripping paint from a brush preparatory to cleaning. Several of the prior art devices show and claim brush wiping means to be a curved surface such as their pouring lip or the inner rim of their attachment means. Because all brushes have bristles arranged in a substantially straight line, this is not an efficient way to perform this necessary operation. A curved surface will remove paint from the outer edges of the brush but very little from the middle portion, resulting in an uneven application of paint to the surface being painted and making it necessary to brush the same area over and over again to get an even coat of paint. Additionally, wiping a brush on the pouring edge of a spout will invariably draw some paint over the edge and it will run down the outside of the spout and either into the lid groove or down the outside of the can.

In a survey made by applicant of eleven cans made by different manufacturers, it was found that their dimensions varied as follows:

(All measurements in inches)

Rim width: 0.530 to 0.582.
Inside diameter of open can top: 5.502 to 5.560.
Outside diameter of can top: 6.604 to 6.685.
Inner rim bead diameter: 0.070 to 0.092.

As can easily be recognized, a pouring device with fixed size attachment means would not work on other cans having different dimensions, either preventing the device from being mounted on the cans or leaving gaps through which paint could leak through into the lid groove.

An example of one patented device having Problem #1 is U.S. Pat. No. 2,106,381, Rough, issued Oct. 23, 1938. Others having this same problem are:

U.S. Pat. No. 2,145,748, Bailey, issued Jan. 31, 1939,
U.S. Pat. No. 2,471,189, Bartels, issued May 24, 1949,
U.S. Pat. No. 2,627,367, Bork, issued Feb. 3, 1953,
U.S. Pat. No. 2,646,193, Best, issued Jul. 21, 1953
U.S. Pat. No. 2,720,346, Compton, issued Oct, 11, 1955,
U.S. Pat. No. 2,765,966, Davis, issued Oct. 9, 1966,
U.S. Pat. No. 2,767,891, Beadles, issued Oct. 23, 1956,
U.S. Pat. No. 3,074,604, Baroud, issued Jan. 22, 1963,
U.S. Pat. No. 3,102,667, Ullevig, issued Sep. 3, 1963,
U.S. Pat. No. 3,221,995, Banaszak, et al, issued Dec. 7, 1965,
U.S. Pat. No. 3,400,867, Giannone, issued Sep. 10, 1968,
U.S. Pat. No. 4,009,802, Hayduchok, issued Mar. 1, 1977,
U.S. Pat. No. 4,299,340, Hrytzak, issued Nov. 10, 1981.

The last patent listed above to Hrytzak provides for several different means for attachment to a can, each made to fit only one dimension on a can, but not just one means that will fit all dimensions.

An example of a patented device having Problem #2 is U.S. Pat. No. 2,106,381, Rough, issued Oct. 23, 1938. Others having the same problem are: Bork, Best, Compton, Beadles, Ullevig, and Banaszak et al, previously listed above. In addition, there are:

U.S. Pat. No. 2,817,465, Gray, issued Dec. 24, 1957,
U.S. Pat. No. 3,853,249, Weir, Jr. et al, issued Dec. 10, 1974,
U.S. Pat. No. 5,012,960, Arnold, issued May 7, 1991.

An example of one patented device having Problem #3 is U.S. Pat. No. 2,106,381, Rough, issued Oct. 23, 1938. Others are: Bailey, Bartels, Best, Davis, Baroud, Banaszak et al, Giannone, and Hrytzak, all previously listed above. Patented devices having problem #4 are all of those listed above.

SUMMARY OF THE INVENTION

The present invention specifically addresses and solves all of the above referenced problems of the prior art, as presented in the preceding background information, in the following manner:

The present invention includes attachment means to compensate for differing dimensions of cans made by different manufacturers. Although various cans hold a specified amount, the can dimensions vary somewhat as pointed out in the survey presented above.

The present invention includes means for effectively preventing paint from running down the outside of the spout itself, into the lid groove, and down the outside of the can by reason of its unique angle of the body and pouring lip coupled with the bead on the underside of the pouring lip edge. It also seals on the inner rim of the can and prevents paint from entering the lid groove from inside the can during a pouring operation.

The present invention preferably encircles the open top of the can for approximately 180 degrees, which prevents paint from running over the inside ends or sides of the spout, assisted by two high sidewalls on either side of the body.

Further, the present invention incorporates a unique brush bar which is separate from the other features of the spout that not only has a straight smooth edge on which to wipe excess paint out of a brush when painting directly from a can, but also preferably includes a serrated edge for stripping most of the paint from the brush in preparation for cleaning after the painting has been completed; a capability not heretofore known or made available in the prior art.

It is therefore a primary object of this invention to provide a pouring spout attachment for paint cans and the like whereby all of the problems listed in the background information above have been eliminated.

Another object is to provide a device that fulfills the requirements of the above object that is also easy and economical to manufacture and which can be cleaned and reused repeatedly.

These and other objects and advantages will be pointed out more fully in the accompanying description and drawings wherein the preferred embodiments of the invention are presented. While paint has been chosen as the primary liquid to be discussed in connection with the invention, it will be understood that there is no limitation imposed by such a choice, but that the invention may be used for pouring liquid materials of all kinds that are contained in cans with which the pouring spout may be used.

DESCRIPTION OF THE PREFERRED EMBODIMENTS

Figure 1:
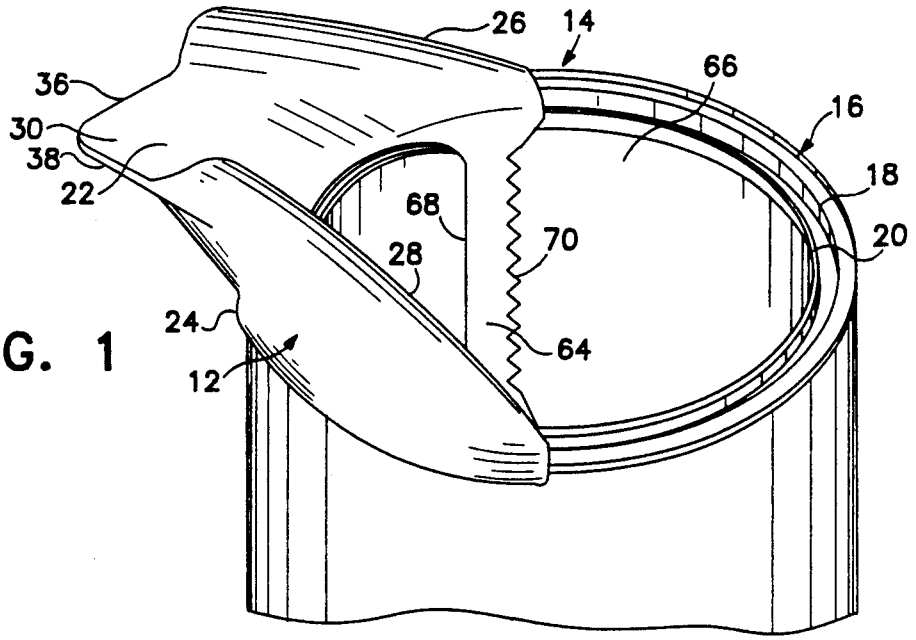
FIG. 1 is an elevation of the spout in the preferred embodiment of the present invention shown in FIGS. 2 and 3 as it appears when mounted on a can.
Figure 2:
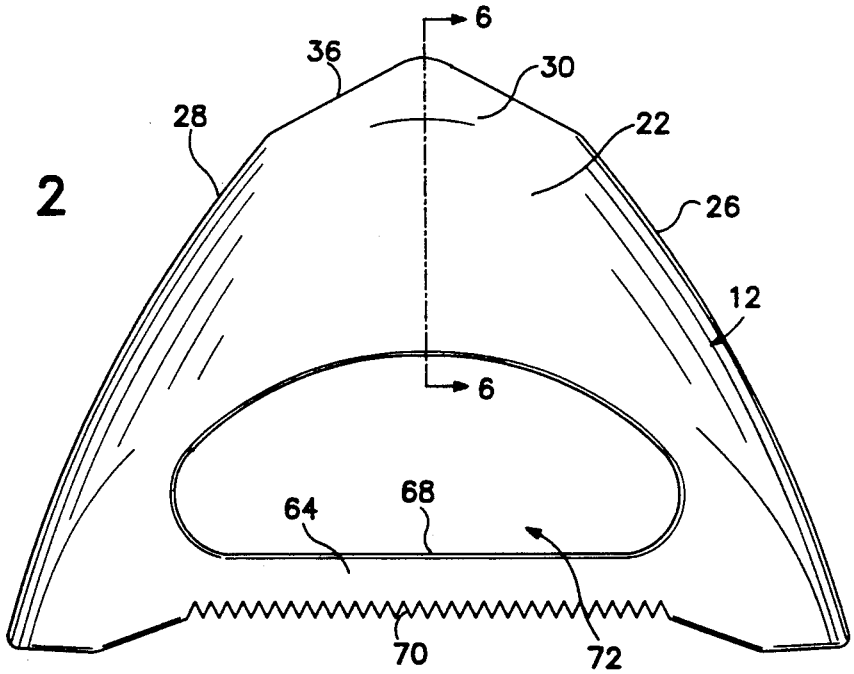
FIG. 2 is a plan view of the spout as seen from the top side.
Figure 9:
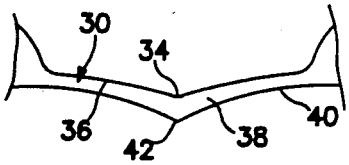
FIG. 9 is a fragmentary plan view of the pouring lip as seen from the right side of FIG. 5.

Referring to FIG. 1, the invention is generally indicated at 12 mounted on a can 14. Can 14 is of the type widely used for various liquid products such as paints, stains, varnishes, cooking oils, syrups, etc. that possesses a relatively wide top rim 16 having a recessed groove 18 for receiving a sealing rib on a can lid (not shown) and a small bead 20 forming the inner periphery of the open can top 66. The invention is preferably formed of a one piece, unitary thermoplastic construction having body 22 extending upwardly at an angular plane of approximately a 45 degree angle from a base section 24 and then curving forwardly through another angle of approximately 45 degrees to terminate in a plane where said body is substantially parallel to base section 24. Two rather high sidewalls 26 and 28 are provided, one on each side of body 22. Sidewalls 26 and 28 help to control and guide the paint to pouring lip 30 and prevent paint from running over the sides of body 22 should can 14 be tilted too far too fast. Sidewalls 26 and 28 extend forwardly along the sides of body 22 and stop at each end of a pouring lip 30. Pouring lip 30, as shown best in FIGS. 2, 9, and 10, is shaped in the form of a wide "V" with the point of the "V" blunted and rounded off as indicated at 32, and further has a shallow trough 34 leading to a sharp pouring edge 36.

Figure 6:
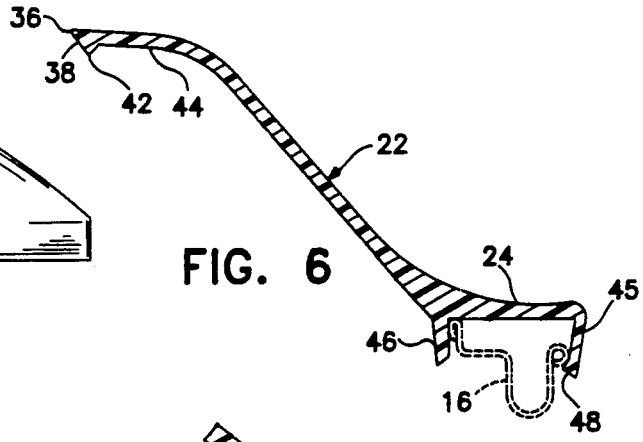
FIG. 6 is an enlarged sectional view taken along line 6—6 of FIG. 2 showing one preferred embodiment of the attachment means installed over a relatively narrow can rim, the can rim being illustrated by phantom lines.
Figure 10:
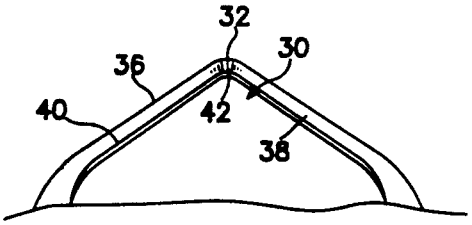
FIG. 10 is a fragmentary plan view of the bottom side of the spout pouring lip of FIG. 9.

An angled surface 38 slants backward underneath sharp edge 36 at an angle of approximately 45 degrees, culminating in a bead 40 with both surface 38 and bead 40 extending along the bottom surface of pouring lip 30, as best seen in FIGS. 6 and 10. A small rounded nodule 42 extends downwardly from the center of edge 36 and acts as an accumulation point for the last vestige of paint that has managed to pass over sharp pouring edge 36.

Regardless of claims made that some pouring devices of this type are "dripless", they cannot be made completely dripless because the free flow of fluid cannot be shut off instantly without some sort of shut-off valve. The configuration of spout 12 of the present invention, however, reduces to an absolute minimum the number of drops that will drip from pouring lip 30 when the pouring action is stopped and can 14 is returned to an upright position as shown in FIG. 1. As can 14 is being raised, the paint will all flow down the sides of the "V"

toward nodule 42 due to the natural surface adhesion tendencies of fluids. Nodule 42, having the lowest surface on forward edge 36, leaves only one spot from which the last few drops will drip. The lowest surfaces of bead 40 and nodule 42 are both lower than bottom surface 44 of pouring lip 30. Therefore, paint cannot run down the outside of body 22 because it cannot naturally run uphill.

Figure 3:
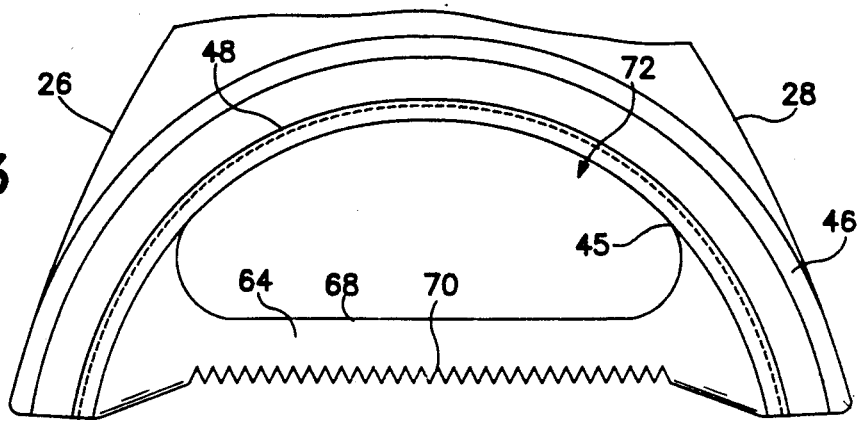
FIG. 3 is a fragmentary plan view of the bottom side of the spout showing the attachment means for one of the preferred embodiments.
Figure 4:
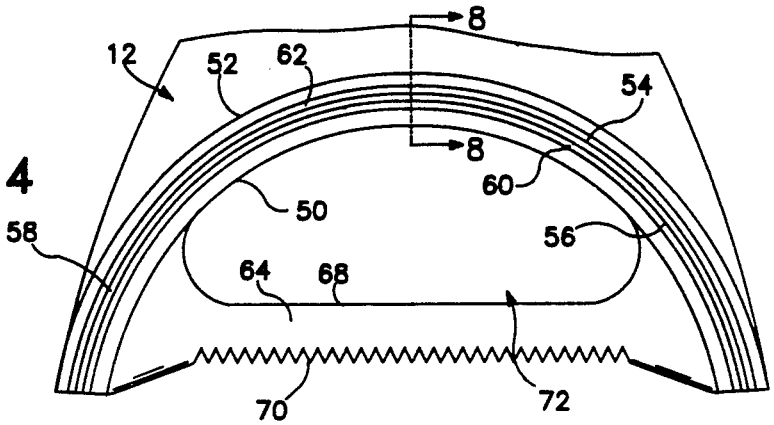
FIG. 4 is a fragmentary plan view of the bottom side of the spout showing the attachment means for another of the preferred embodiments.
Figure 5:
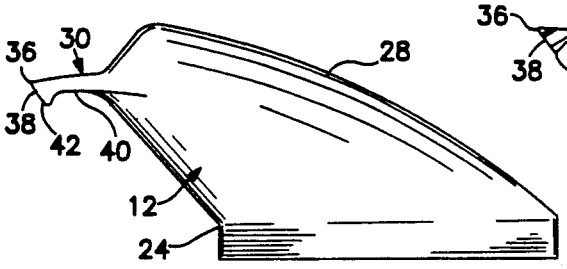
FIG. 5 is a left side elevational view of the spout, the right side being a mirror image thereof.
Figure 7:
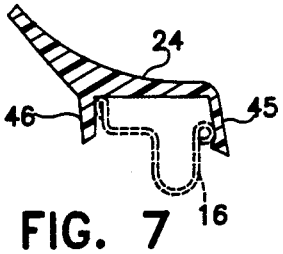
FIG. 7 is a fragmentary sectional view of a preferred embodiment shown in FIG. 6 showing the attachment means installed on a relatively wide can rim which is illustrated by phantom lines.

Continuing with the description, base section 24 in the embodiment shown in FIG. 3, 6, and 7 includes an attachment means comprising two short walls 45 and 46 extending downwardly therefrom. Walls 45 and 46 fit entirely over can rim 16 as shown in FIGS. 6 and 7. A rib section 48 extends entirely around the inner edge of inner wall 45 and inner wall 45 is angled inwardly approximately 10 degrees toward outer wall 46. Rib section 48 snaps down over bead 20 to hold spout 12 firmly on can 14 and also holds inner wall 45 tightly against bead 20, thereby preventing paint from getting into lid groove 18 from inside can 14 during a pouring operation. Inner wall 45 is preferably formed having a cross-sectional thickness slightly less than outer wall 46 such that wall 45 will flex more readily than will wall 46. As will be recognized due to the angled inclination of wall 45 relative to wall 46, as well as the flexible nature of the thermoplastic material of wall 45, the attachment means can properly mount the spout to differing can dimensions as indicated in FIGS. 6 and 7, with wall 45 flexing outwardly as required to abut the periphery of the bead formed on the inner rim of the paint can while wall 46 directly abuts the outer rim of the paint can. This action takes place regardless of whether the can rim is within the smaller or larger width range reported in the survey presented previously herein.

Figure 8:
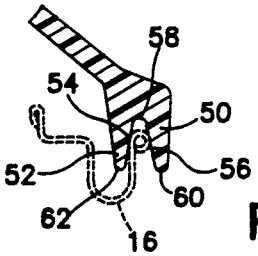
FIG. 8 is an enlarged fragmentary sectional view taken along lines 8—8 of FIG. 4 showing another preferred embodiment of the attachment means that automatically adjusts to different can dimensions, with the rim being illustrated by phantom lines.

In a second preferred embodiment as shown in FIG. 8, there are two dowardly projecting walls 50 and 52 in close proximity to each other and extending entirely around base section 24. Both walls 50 and 52 have inner tapered surfaces 54 and 56 forming a slot 58 that is narrower at its inner end than at its outer end. Slot 58 is placed over bead 20 and spout 12 is then pressed downward to frictionally engage tapered surfaces 54 and 56 with bead 20 on can 14. Outer ends 60 and 62 of walls 50 and 52 are rounded to facilitate ease of inserting bead 20 into slot 58. Variations in can dimensions previously mentioned are compensated for by the tapered slot 58 accepting beads of differing diameters, and differing diameters of open can tops is compensated for by walls 50 and 52 having sufficient flexibility to adapt to any narrower or wider diameters that are encountered.

A thin, relatively flat brush wipe bar 64 approximately one-half inch wide and approximately one-sixteenth inch thick extends across the open can top 66. Bar 64 has a straight smooth edge 68 that is normally used to wipe excess paint out of a brush when drawing paint directly from a can for a painting operation. A serrated edge 70 is located opposite smooth edge 68 and is primarily for the purpose of stripping most of the paint from a brush preparatory to cleaning it. The serrations will penetrate the bristles of a brush much more deeply and present approximately twice as much wiping surface as does a smooth edge and therefore will remove considerably more paint per wipe. Serrated edge 70 may, however, be used to wipe excess paint out of a brush during the painting operation when the paint is quite thick or a large brush is being used. Bar 64 also serves a secondary but no less important function of blocking paint being poured from a full can and forcing it to pass through orifice 72, thereby controlling the volume of paint flowing over body 22 and pouring lip 30.

It will be understood that the invention described and illustrated herein is presented in its preferred embodiments only for the purpose of explanation, and that it is not necessarily limited to such forms but may be changed and adapted, within the true scope of the invention, to any other purpose for which it may be suitable. Correspondingly, the present invention should be defined by the scope of the following claims only, and not solely in accordance with those preferred forms within which the present invention has been taught.

I claim:

1. A one piece pouring spout for attaching to an can having a bead & defining the inner rim of an open top of said can comprising a. a body section extending upwardly from a base section at an angular plane of approximately 45 degrees from a vertical plane, then curving forward through another angle of approximately 45 degrees to terminate in a plane where said body is substantially parallel to said base section;

b. a pouring lip on a forward end of said body section remote from said base section, said pouring lip being formed substantially in the shape of a wide "V" and further having a shallow trough in its top surface and a pouring edge;

c. a flat surface angled backward underneath the edge of said pouring lip providing a sharp pouring edge on said pouring lip, said flat surface culminating in a bead extending along the bottom surface of said sharp pouring edge;

d. a small rounded nodule extending downwardly from the center of said pouring edge; and e. an inner wall and an outer wall projecting downwardly from said base section in close proximity to each other and extending entirely around the bottom of said base section, said inner and outer walls forming a slot that is narrower at its inner end than at its outer end by means of tapered inner surfaces, said inner surfaces of said inner and outer walls being angled inwardly toward each other to accomodate the insertion of can beads having differing diametrical dimensions.

2. The spout attachment of claim 1 wherein said inner surfaces of said inner and outer walls are angled inwardly toward each other approximately 5 to 10 degrees.

3. The spout of claim 1 wherein the inner wall facing the inside of said can is thinner in cross section than the outer wall so that said inner wall has more flexibility than said outer wall, thereby providing an attachment means that will automatically adjust to different dimensions found in the diameter of said open top of cans.

4. The spout attachment of claim 1 further including a thin, relatively flat brush bar extending across said open top of said can, said brush bar having a smooth straight surface on one edge and an opposed serrated surface on an opposite edge.

5. The spout attachment of claim 4 wherein said brush bar is approximately ½-inch wide and 1/16-inch thick.

6. A one piece pouring spout for attaching to a can having a top rim section with a recessed groove for receiving a can lid and a bead defining the inner periphery of the open top of said can, said spout comprising:

a. an inner wall and an outer wall extending downwardly from a base section of said spout, said inner and outer walls being spaced apart sufficiently so that said base section will completely cover said rim section, said inner wall being longer and thinner in cross-section than said outer wall and angled inward toward said outer wall, the two walls flexing sufficiently when said spout is installed on said can to compensate for any variation in dimensions of said top rim section;

b. a narrow rib on the inside surface of said inner wall projecting inwardly toward said outer wall and extending partially around the inner circumference of said inner wall, said rib snapping down over said bead and sealing said inner wall firmly against said beam, said inner wall angling inwardly toward said outer wall approximately 0.025 of an inch and capable of flexing outwardly away from said outer wall a distance of approximately 0.050 of an inch;

c. a body extending upwardly from said base section at an angular plane of approximately 45 degrees from a vertical plane and then curving forward through an angle of approximately another 45 degrees to terminate in a plane where said body is substantially parallel to said base section;

d. a pouring lip on a forward end of said body remote from said base section in the form of a shallow trough and further projecting forward in a wide "V" configuration;

e. an angular surface underneath a forward edge of said lip providing a sharp pouring edge, said angular surface projecting downwardly at approximately a 45-degree angle and forming a bead beneath said forward edge; and f. a rounded nodule extending downwardly from the center of said sharp pouring edge, the lowest surface of said nodule and said bead of said forward edge being lower than a bottom surface of said body immediately adjacent thereto, thereby preventing any fluid being poured from running down the underside of said spout.

* * * * *